US006129533A

United States Patent [19]

Brandt et al.

[11] Patent Number: 6,129,533

[45] Date of Patent: Oct. 10, 2000

[54] SEALING SYSTEM FOR ROTATING COMPONENT OF A PUMP

[75] Inventors: Jens-Uwe Brandt, Rinteln; Gerhard Rohlfing, Hille; Vejen Hristov, Bueckeburg, all of Germany

[73] Assignee: Joh. Heinr. Bornemann GmbH, Obernkirchen, Germany

[21] Appl. No.: 09/272,167

[22] Filed: Mar. 18, 1999

[30] Foreign Application Priority Data

Apr. 11, 1998 [EP] European Pat. Off. ..... 98106690

[51] Int. Cl.[7] ..... F04C 2/00

[52] U.S. Cl. ..... 418/104; 418/202; 418/15; 418/102; 418/201.2; 418/189; 277/563; 277/585; 277/59; 384/130; 384/131; 384/132; 384/147; 308/36.1

[58] Field of Search ..... 418/201.2, 202, 418/104, 15, 102, 189; 277/563, 585, 59; 384/130, 131, 132, 147; 308/36.1, 3.5

[56] References Cited

U.S. PATENT DOCUMENTS

| | | | |
|---|---|---|---|
| 1,673,259 | 6/1928 | Meston et al. | 418/202 |
| 2,549,633 | 4/1951 | Farhat | 308/36.1 |
| 2,710,581 | 6/1955 | Rosaen . | |
| 2,758,548 | 8/1956 | Rockwell . | |
| 3,527,507 | 9/1970 | Clark et al. | 308/3.5 |
| 3,575,426 | 4/1971 | Durham | 277/59 |
| 3,589,843 | 6/1971 | Zalis | 418/202 |
| 3,667,879 | 6/1972 | Cerpelli | 418/202 |
| 3,718,378 | 2/1973 | Clay | 308/36.1 |
| 4,153,395 | 5/1979 | O'Neill . | |
| 4,684,335 | 8/1987 | Goodridge | 418/189 |
| 5,624,249 | 4/1997 | Rohlfing . | |

FOREIGN PATENT DOCUMENTS

| | | | |
|---|---|---|---|
| 27 40 161 | 3/1978 | Germany . | |
| 43 16 735 | 11/1994 | Germany . | |
| 59-51190 | 3/1984 | Japan | 418/104 |
| 2 138074 | 10/1984 | United Kingdom . | |
| 2182393 | 5/1987 | United Kingdom | 418/202 |

*Primary Examiner*—Thomas Denion
*Assistant Examiner*—Thai-Ba Trieu
*Attorney, Agent, or Firm*—Foley & Lardner

[57] ABSTRACT

The invention relates to a fluid-conveying machine, in particular, a pump having a component rotating in a stationary housing part inside an annular gap. The stationary housing part separates an interior having a higher product pressure from an exterior having a lower pressure. A rotating component is mounted in an external bearing which is sealed with respect to the interior via a sealing system. In order to improve the sealing, the invention provides that the annular gap is formed between two sliding bearing shells which comprise extremely hard, wear-resistant materials and, in accordance with the operating principle of a radial sliding bearing, form a first pressure-reducing stage. A feedback device, which feeds back the leakage from this first sealing stage into the conveying process of the machine, is connected downstream of the first pressure-reducing stage. A second sealing stage is arranged axially downstream of the feedback device. The second sealing stage may be constructed as a simple seal, such as a lip seal and/or a simple end face seal.

30 Claims, 3 Drawing Sheets

SEALING SYSTEM FOR ROTATING COMPONENT OF A PUMP

BACKGROUND OF THE INVENTION

1. Field of the Invention

The invention relates to a fluid-conveying machine, particularly, a pump, having a component rotating in a stationary housing part inside an annular gap, the stationary housing part separating an interior having a higher product pressure from an exterior having a lower pressure, and in which the rotating component is mounted in an external bearing which is sealed with respect to the interior via a sealing system.

2. Description of Related Art

A related device is disclosed in DE 43 16 735 C2, which discloses a screw pump having at least one conveyor screw which is surrounded by a housing which has at least one suction connection and at least one pressure connection, the suction connection being connected to a suction chamber connected upstream of the conveyor screw, and the pressure connection being connected to a pressure chamber arranged downstream of the conveyor screw. The housing also has devices for separating the respective liquid phase from the gas phase of the liquid flow emerging from the conveyor screw, and a lower section for holding at least a portion of the separated liquid phase. A liquid short-circuiting line is connected to the lower pressure chamber section. The liquid-short circuiting line is also connected to the suction chamber and, together with the conveying elements, forms a closed circuit for a liquid quantity required for the permanent seal.

Numerous sealing systems have been developed for sealing rotating shafts, but they have proven to be disadvantageous for machines of the aforementioned design. Contactless labyrinth seals are disadvantageous, because of their high rate of leakage resulting from the existence of relatively large gaps, and because no pressure differences can be tolerated at the shaft bushing. Lip seals tolerate only slight pressure differences up to a maximum of 5 bars on the shaft bushing. Soft packings likewise have relatively high rates of leakage, require a high level of outlay and maintenance, and develop a large amount of heat at high rotational speeds. The end face seals used in pumps of advanced design prove to be disadvantageous because of their complex structure and the difficulty of commissioning them.

The difficulties suggested in the preceding are not intended to be exhaustive but rather are among many which tend to reduce the effectiveness and desirability of the known seals. Other noteworthy problems may also exist, however, those presented above should be sufficient to demonstrate that such methods and apparatuses appearing in the past will admit to worthwhile improvement.

SUMMARY OF THE INVENTION

Accordingly, it is therefore a general object of the invention to provide a sealing system for the rotating component that will obviate or minimize difficulties of the type previously described.

It is a specific object of the invention to provide a machine of the aforementioned design having an improved sealing system for the rotating component.

It is another object of the invention to provide a sealing system which reduces leakage as compared to those described above.

It is still another object of the invention to provide a sealing system that is easy to manufacture and is cost-effective.

It is a further object of the invention to provide a sealing system that reduces required maintenance.

It is yet a further object of the invention to provide a sealing system that can withstand pressure differentials.

A preferred embodiment of the invention which is intended to accomplish at least some of the foregoing objects includes a sealing system comprising a first sealing stage having a two sliding bearing shells; and an annular gap formed between the two sliding bearing shells; wherein the two sliding bearing shells comprise a hard, wear-resistant material; and a feedback device located downstream from the first pressure reducing stage; and a second sealing stage located downstream of the feedback device, wherein the feedback device feeds a leakage from the first sealing stage into the pump interior.

Another preferred embodiment is a pump comprising a housing; a shaft rotating in a housing part, which separates an interior of the housing from an exterior of the housing; an external bearing for mounting the shaft; and a sealing system for sealing the external bearing from the interior of the housing, wherein the sealing system includes: two bearing shells mounted in a radial direction of the housing part; an annular gap formed between the two bearing shells; a feedback device connected downstream from the two bearing shells and the annular gap; and a seal located downstream of the feedback device; wherein the bearing shells comprise a hard, wear-resistant material; and wherein the feedback device feeds a leakage from the annular gap to the housing.

Additional objects and advantages of the invention will be set forth in the following description, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENTS

The objects of the invention are achieved, starting from the machine described at the beginning, by providing an annular gap that is formed between two sliding bearing shells, which consist of extremely hard, wear-resistant materials and, in accordance with the operating principle of a radial sliding bearing, form a first pressure-reducing stage. A feedback device, which feeds back the leakage from this first sealing stage into the conveying process of the fluid-flowing machine, is connected axially downstream from the first pressure-reducing stage. A second sealing stage is arranged axially downstream of the feedback device, which is constructed as a simple seal, e.g., a lip seal and/or a simple end face seal.

A two-stage sealing system is therefore provided. The first stage reduces pressure and employs the operating principle of a radial sliding bearing with build-up of a hydrodynamic oil wedge. The sliding bearing shells may comprise solid industrial ceramic (e.g., aluminum oxide based or zirconium oxide based), solid hard metals (e.g., silicon carbide based or tungsten carbide based), or coated metals (e.g., hard-chrome plated, tungsten carbide coated or chromium oxide coated). The structure of this first sealing stage is advantageous, because an effective hydrodynamic oil wedge builds up from the liquid of the conveyed medium conveyed and any particles penetrating the annular gap are pulverized between the sliding bearing shells due to the extreme hardness and wear resistance of the shells. To correct alignment errors, it is preferable to mount the sliding bearing shells elastically in the radial direction, e.g., the sliding bearing shells may be mounded in O rings.

The feedback of the leakage, which leaks from the first sealing stage, is achieved, e.g., as a result of a suitable pressure gradient between the outlet and inlet sides of the machine (when the seal is arranged on the outlet side) or, e.g., via an external aid such as a pump (when the seal is arranged on the inlet side). In a screw pump of the design described at the beginning, it is particularly advantageous to connect the leakage feedback device to the liquid short-circuiting line.

The second sealing stage minimizes the leakage resulting from the slightest pressure differences to protect the environment or the mechanical elements of the fluid-flowing machine. In this case, the second sealing stage can be constructed as a simple sealing system in the form of a lip seal or an end face seal. Depending on the application required, the second sealing stage may be constructed also as a multipartite system of sealing systems of conventional design, e.g., a lip seal with an end face seal connected downstream or a V ring with a lip seal connected downstream and an end face seal connected downstream from there.

Figure 1:
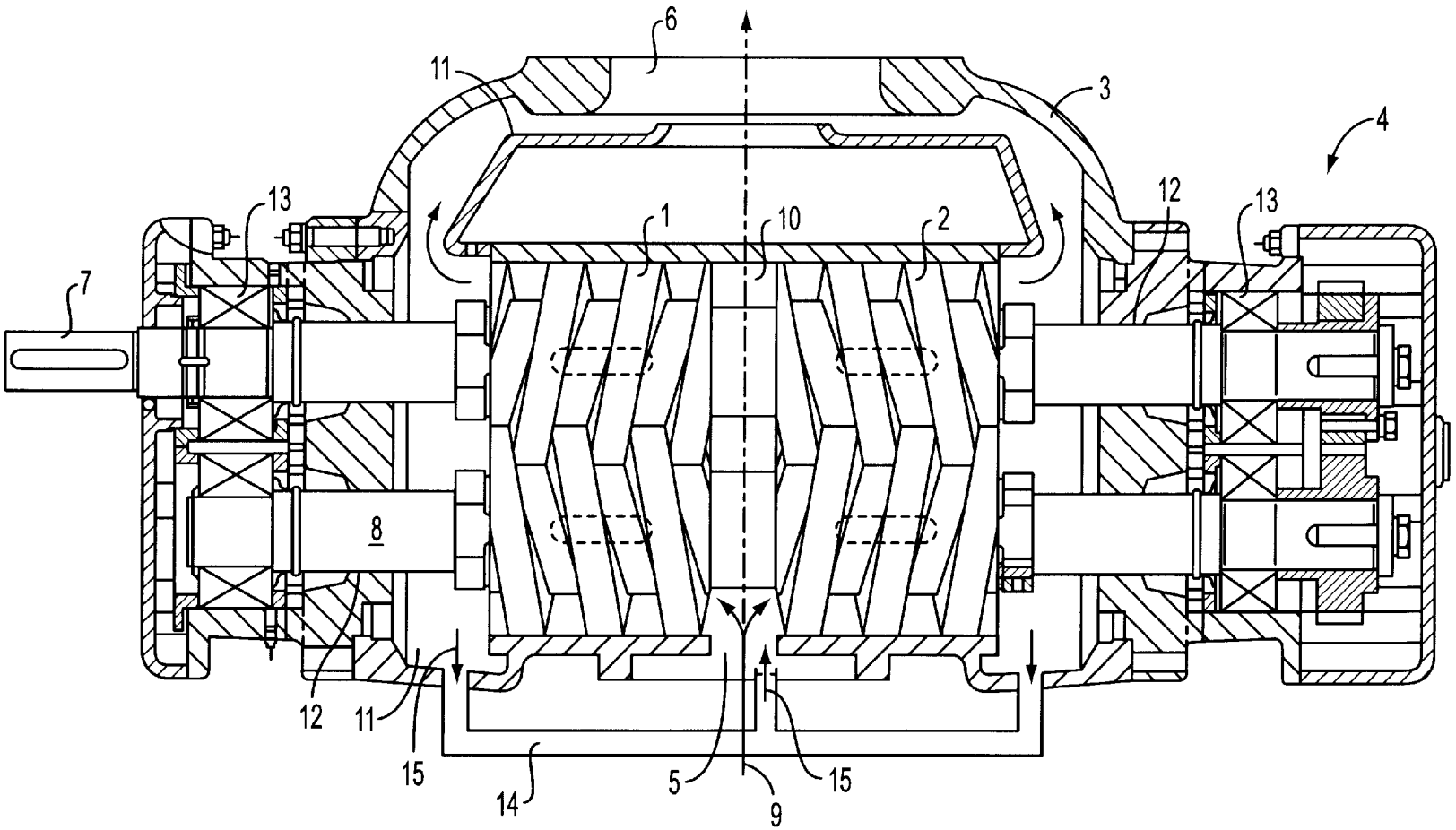
FIG. 1 (PRIOR ART)
FIG. 1 is a prior art longitudinal section through a screw pump.

Referring now to the drawings, wherein like numerals indicate like parts, and initially to FIG. 1, there will be seen a previously known (see DE 43 16 735 C2) screw pump having two oppositely rotating pairs of conveyor screws as conveying elements. The two oppositely rotating pairs of conveyor screws intermesh without contact and, in each case, comprise a right-hand conveyor screw 1 and a left-hand conveyor screw 2. Together with the housing 3 surrounding them, the inter-engaging conveyor screws form individually sealed conveying chambers. A gear train 4, which is arranged outside the pump housing, transmits torque from the drive shaft to the driven shaft. The pump housing 3 has a suction connection 5 and a pressure connection 6. The medium 9 flowing to the pump through the suction connection 5 is fed in the pump housing 3 in two partial currents to the respective center suction chamber 10, which is connected upstream of the assigned conveyor screws 1 or 2. A pressure chamber 11 is connected downstream of each of the conveyor screws 1 or 2. The pressure chamber 11 is sealed axially from the outside by a shaft seal 12 which seals an external bearing 13.

A liquid short-circuiting line 14 is connected to the lowest point of the pressure chamber 11. The liquid short-circuiting line is also connected to the suction chamber 10. The partial liquid volumetric flow separated from the conveyed liquid/gas mixture and fed back in a metered fashion into the suction region is marked by the arrow 15 and is conveyed again from the suction chamber 10 into the pressure chamber 11 as a liquid circulation.

Generally, the liquid level in the pump housing 3 or pressure chamber 11 may be maintained at a level that is below the shafts 7, 8. Generally the direct incident flow, which wets the shaft seals 12, is sufficient to lubricate adequately the shaft seals 12.

Figure 2:
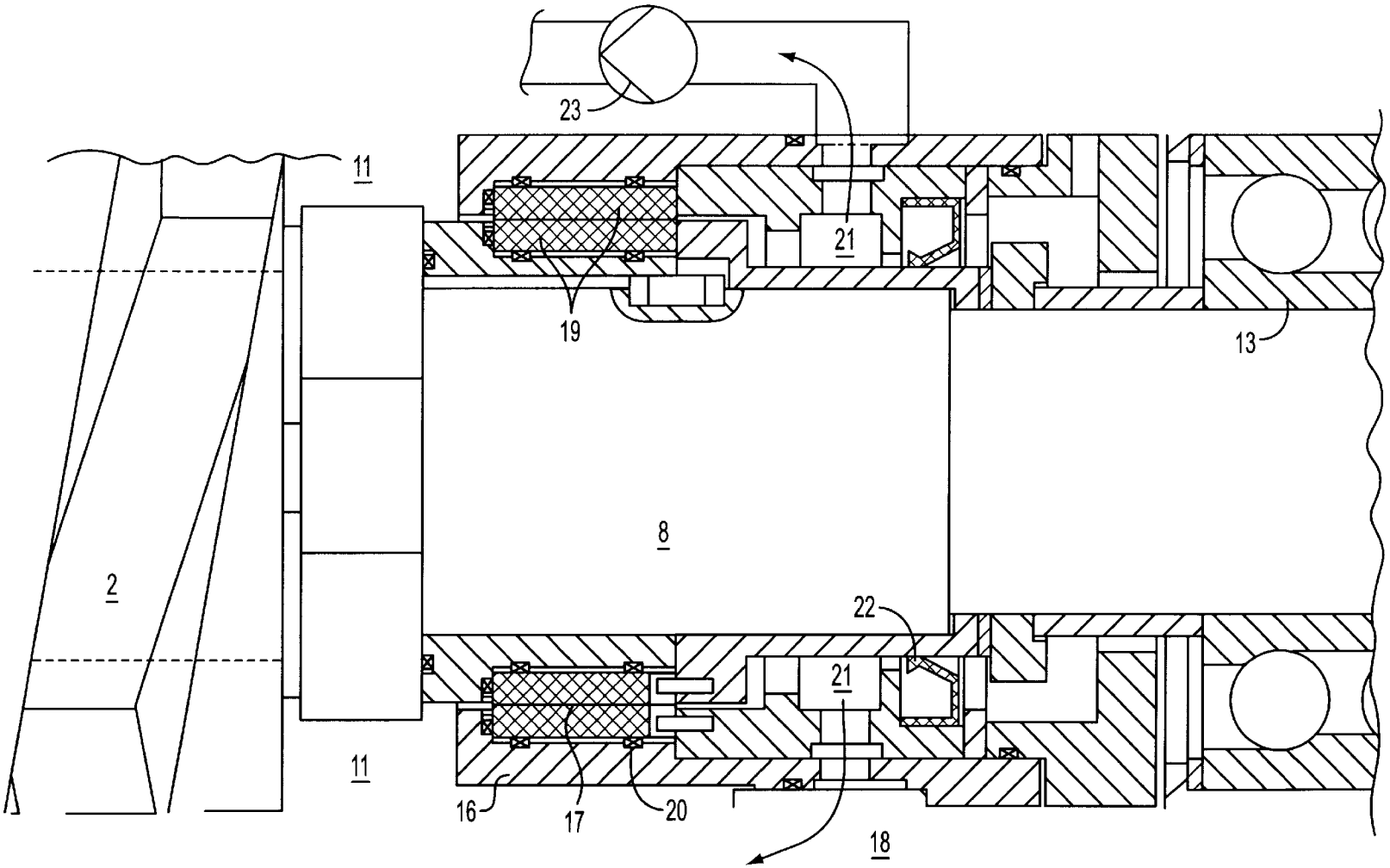
FIG. 2 is, on a scale enlarged by comparison with FIG. 1, a sealing system according to the invention in—referred to FIG. 1—the right-hand bearing region of a conveyor screw.

FIG. 2 shows an exemplary embodiment of the invention. The shaft 8 rotates inside a stationary housing part 16. An annular gap is locate inside the stationary housing part 16. The stationary housing part 16 separates an interior having higher product pressure, which is the pressure chamber 11 of FIG. 1, from an external space 18 having a lower pressure. The shaft 8 is mounted in an external bearing 13 in the external space 18.

The external bearing 13 is sealed with respect to the pressure chamber 11, via the following sealing system. The annular gap 17 is formed between two sliding bearing shells 19 which are comprised of extremely hard, wear-resistant materials and are elastically mounted, to correct alignment errors, in the radial direction with the aid of O rings 20. A feedback device 21, which feeds back the leakage that flows through the annular gap 17 from the first sealing stage into the conveying process of the fluid-flow machine, is connected in the axial direction downstream of the first pressure-reducing stage. The first pressure-reducing stage is formed by the sliding bearing shells 19. A separate pump 23 preferably is provided for the feedback device 21. If the sealing system according to the invention is used in a screw pump as shown in accordance with FIG. 1, it is preferable for the leakage feedback device 21 to be connected to the liquid short-circuiting line 14.

A second sealing stage 22 is arranged axially downstream from the feed back device 21. The second sealing stage 22 may be constructed as a simple seal, such as a lip seal.

Figure 3:
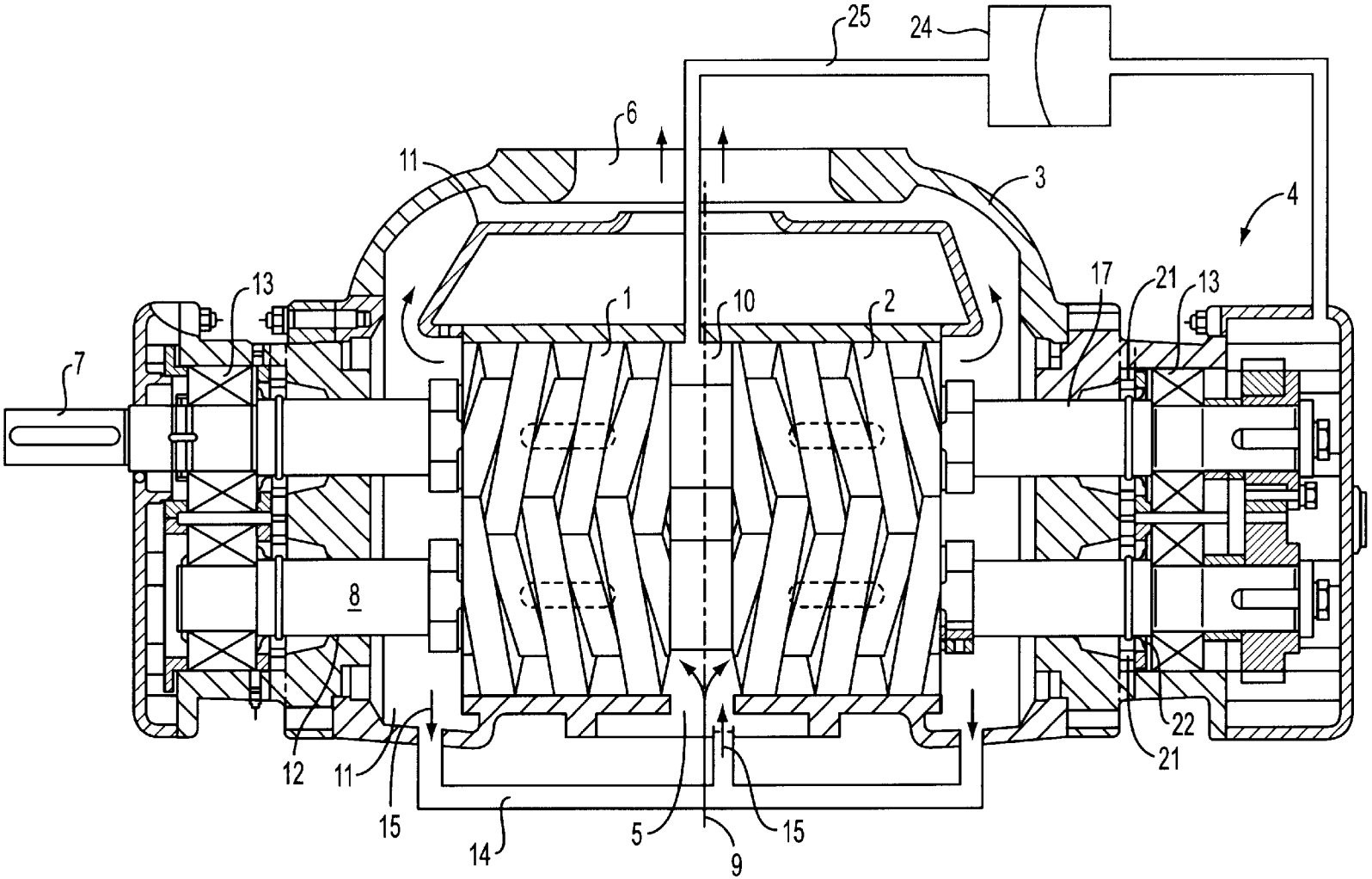
FIG. 3 is the screw pump in accordance with FIG. 1 with a pressure-equalizing device according to the invention.

FIG. 3 shows a screw pump in accordance with FIG. 1 and having a sealing system (indicated only diagrammatically) according to the invention and in accordance with FIG. 2, and an additionally provided pressure-equalizing device 24 according to the invention. The pressure-equalizing device is connected into a line 25, which connects the installation space of the external bearing 13 to the suction chamber 10. The pressure-equalizing device 24 preferably may be a diaphragm a bag-type accumulator. The pressure-equalizing device 24 ensures that the same pressure level exists in the entire installation space as in the suction chamber 10. This arrangement is particularly advantageous to minimize pressure differences at the second sealing stage 22 when changing pressures in the suction chamber 10.

Preferably, the thickness of the annular gap 17 formed between the sliding bearing shells 19 is approximately 0.3 to 1.5% of the sliding surface diameter. Also, preferably, the length of the sliding bearing shells 19 is approximately 20 to 60% of the sliding surface diameter.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A sealing system for separating an interior of a pump from an exterior, comprising:

first sealing stage having:

a two sliding bearing shells; and an annular gap formed between the two sliding bearing shells;

wherein the two sliding bearing shells comprise a hard, wear-resistant material; and a feedback device located downstream from the first pressure reducing stage; and a second sealing stage located downstream of the feedback device;

wherein the feedback device feeds a leakage from the first sealing stage into the pump interior.

2. A sealing system as claimed in claim 1, wherein the two bearing shells are elastically mounted.

3. A sealing system as claimed in claim 1, further comprising a plurality of O-rings for elastically mounting the bearing shells.

4. A sealing system as claimed in claim 1, further comprising a feedback pump arranged in the feedback line.

5. A sealing system as claimed in claim 1, wherein the second sealing stage comprises a lip seal.

6. A sealing system as claimed in claim 1, wherein the second sealing stage comprises an end face seal.

7. A sealing system as claimed in claim 1, wherein the two bearing shells comprise a solid industrial ceramic.

8. A sealing system as claimed in claim 1, wherein the two bearing shells comprise a solid hard metal.

9. A sealing system as claimed in claim 1, wherein the two bearing shells comprise a coated metal.

10. A sealing system as claimed in claim 1, wherein the second sealing stage comprises a plurality of seals.

11. A sealing system as claimed in claim 1, wherein the two sliding bearing shells act together as a radial sliding bearing.

12. A sealing system as claimed in claim 1, wherein a thickness of the annular gap is approximately between 0.3% to 1.5% of a sliding surface diameter of a shaft of the pump.

13. A sealing system as claimed in claim 1, wherein a length of the at least two bearing shells is approximately between 20% to 60% of a sliding surface diameter of a shaft of the pump.

14. A sealing system for separating an interior of a pump from an exterior, comprising:

at least two bearing shells mounted in a radial direction of a pump housing;

at least one annular gap formed between the at least two bearing shells;

a feedback device connected downstream from the at least two bearing shells and the annular gap; and a seal located downstream of the feedback device;

wherein the at least two bearing shells comprise a hard, wear-resistant material; and wherein the feedback device feeds a leakage from the annular gap to the pump interior.

15. A sealing system as claimed in claim 14, wherein there are two bearing shells.

16. A sealing system as claimed in claim 15, wherein there is only one annular gap.

17. A pump comprising:

a housing;

a shaft rotating in a housing part, which separates an interior of the housing from an exterior of the housing;

an external bearing for mounting the shaft; and a sealing system for sealing the external bearing from the interior of the housing, wherein the sealing system includes:

two bearing shells mounted in a radial direction of the housing part;

an annular gap formed between the two bearing shells;

a feedback device connected downstream from the two bearing shells and the annular gap; and a seal located downstream of the feedback device;

wherein the bearing shells comprise a hard, wear-resistant material; and wherein the feedback device feeds a leakage from the annular gap to the housing.

18. A pump as claimed in claim 17, further comprising a pressure-equalizing device connecting the pump housing exterior to the pump housing interior.

19. A pump as claimed in claim 18, further comprising a fluid line connecting the pressure-equalizing device to the housing interior and exterior.

20. A pump as claimed in claim 19, wherein one end of the fluid line is connected to an installation space of the external bearing and a suction chamber of the pump interior.

21. A pump as claimed in claim 18, wherein the pressure-equalizing device is a diaphragm.

22. A pump as claimed in claim 18, wherein the pressure-equalizing device is a bag-type accumulator.

23. A pump as claimed in claim 20, wherein the pressure-equalizing device ensures that a pressure in the installation chamber equals a pressure in the suction chamber.

24. A pump comprising:

a housing having at least one conveying chamber and at least one suction connection and at least one pressure connection;

a pressure chamber located downstream from the at least one conveying chamber;

a short-circuiting line connected to the pressure chamber at one end and the suction chamber at another end;

a shaft rotating in a stationary housing part and mounted in an external bearing, wherein the stationary housing part separates the pressure chamber from an external space containing the external bearing; and a sealing system for sealing the pressure chamber from the external space, wherein the sealing system includes:

a first sealing stage including:

two sliding bearing shells mounted radially in the stationary housing part; and an annular gap located between the two sliding bearing shells;

a feedback device downstream of the first sealing stage for feeding a leakage from the first sealing stage into the pump housing; and a second sealing stage downstream of the feedback device.

25. A pump as claimed in claim 24, wherein the feedback device is connected to the short-circuiting line.

26. A pump as claimed in claim 24, further comprising a pressure-equalizing device connected into a line that connects the external space to the suction chamber.

27. A pump as claimed in claim 26, wherein the pressure-equalizing device is a diaphragm.

28. A pump as claimed in claim 26, wherein the pressure-equalizing device is a bag-type accumulator.

29. A pump as claimed in claim 24, wherein a thickness of the annular gap is approximately between 0.3% to 1.5% of a sliding surface diameter of the shaft.

30. A pump as claimed in claim 24, wherein a length of the two bearing shells is approximately between 20% to 60% of a sliding surface diameter of the shaft.

* * * * *